US007210305B2

(12) United States Patent
Shin

(10) Patent No.: US 7,210,305 B2
(45) Date of Patent: May 1, 2007

(54) OUTDOOR UNIT FOR AIR CONDITIONER

(75) Inventor: Sang Ho Shin, Seongnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 389 days.

(21) Appl. No.: 10/782,752

(22) Filed: Feb. 23, 2004

(65) Prior Publication Data

US 2005/0034471 A1 Feb. 17, 2005

(30) Foreign Application Priority Data

Aug. 14, 2003 (KR) ..... 10-2003-0056358

(51) Int. Cl.
*F25D 17/04* (2006.01)

(52) U.S. Cl. ..... 62/285

(58) Field of Classification Search ..... 62/285
See application file for complete search history.

(56) References Cited

U.S. PATENT DOCUMENTS 4,416,327 A * 11/1983 Nakada et al. ..... 165/122
6,497,255 B1 * 12/2002 Adams et al. ..... 138/149
6,701,739 B2 * 3/2004 Morse ..... 62/277
2002/0056283 A1 * 5/2002 Kim ..... 62/285

FOREIGN PATENT DOCUMENTS

JP 7-318108 12/1995

* cited by examiner

*Primary Examiner*—Cheryl Tyler
*Assistant Examiner*—Michael J. Early
(74) *Attorney, Agent, or Firm*—Staas & Halsey LLP

(57) ABSTRACT

An outdoor unit for an air conditioner allows condensed water generated from an outdoor heat exchanger to be easily discharged, and prevents coldness from the outdoor heat exchanger from being transmitted to a bottom of the outdoor unit, thus preventing freezing of the condensed water on the bottom. The outdoor unit includes a cabinet having a bottom panel, an outdoor heat exchanger installed in the cabinet, and a support member made of heat insulating material supporting the outdoor heat exchanger with a spacing between a lower end of the outdoor heat exchanger and the bottom panel of the cabinet, to prevent condensed water generated from the outdoor heat exchanger from freezing.

6 Claims, 4 Drawing Sheets

OUTDOOR UNIT FOR AIR CONDITIONER

CROSS-REFERENCE TO RELATED APPLICATIONS

This application claims the benefit of Korean Patent Application No. 2003-56358, filed Aug. 14, 2003 in the Korean Intellectual Property Office, the disclosure of which is incorporated herein by reference.

BACKGROUND OF THE INVENTION

1. Field of the Invention

The present invention relates to an air conditioner, and more particularly, to an outdoor unit for an air conditioner, which is designed to prevent condensed water from forming on a heat exchanger.

2. Description of the Related Art

Generally, a separated-type air conditioner includes an indoor unit installed inside a building and an outdoor unit installed outside a building, in which the indoor unit and the outdoor unit are connected to each other via refrigerant piping. The indoor unit usually includes an indoor heat exchanger to generate coldness by heat exchange, and a circulating fan to circulate air in a room. The outdoor unit includes a compressor, an outdoor heat exchanger, and a blower fan to cool the outdoor heat exchanger by blowing outdoor air.

When the air conditioner is operated in a heating mode, the outdoor heat exchanger included in the outdoor unit is maintained in a cooled condition. Accordingly, condensed water is formed on a surface of the outdoor heat exchanger, and the condensed water flows downward. To discharge the condensed water, a bottom plate of the outdoor unit of the air conditioner is provided with a drain hole.

In the outdoor unit of the conventional air conditioner, since a lower end of the outdoor heat exchanger is supported on a bottom plate of a cabinet of the outdoor unit, it is difficult to discharge the condensed water present between the lower end of the outdoor heat exchanger and the bottom plate of the cabinet, thus freezing of the condensed water occurs. Accordingly, ice expands upward from the lower end of the heat exchanger and becomes progressively larger, thus lowering heat-exchange efficiency.

Furthermore, since the conventional outdoor unit for an air conditioner is constructed such that a bottom plate of a cabinet thereof is usually made of metal, coldness from an outdoor heat exchanger is transmitted to the bottom plate of a cabinet in a heating operation, thus promoting freezing of the condensed water.

SUMMARY OF THE INVENTION

Accordingly, it is an aspect of the present invention to provide an outdoor unit for an air conditioner, which allows condensed water generated from an outdoor heat exchanger to be easily discharged, thereby preventing the condensed water from freezing.

It is another aspect of the present invention to provide an outdoor unit for an air conditioner, which prevents coldness from an outdoor heat exchanger from being transmitted to a bottom plate of the outdoor unit, thus preventing freezing of the condensed water.

Additional aspects and/or advantages of the invention will be set forth in part in the description which follows and, in part, will be obvious from the description, or may be learned by practice of the invention.

The above and/or other aspects are achieved by providing an outdoor unit for an air conditioner, including a cabinet having a bottom panel, an outdoor heat exchanger installed in the cabinet, and a support member supporting the outdoor heat exchanger with a space between a lower end of the outdoor heat exchanger and the bottom panel of the cabinet, to prevent condensed water generated from the outdoor heat exchanger from freezing.

The support member may include heat insulating material.

The bottom panel of the cabinet may include a flange extending upward at an edge of the cabinet, and the support member may be attached to the flange.

The support member may include a fixing portion attached to the flange, and a support portion extended from the fixing portion to support a lower end of the heat exchanger.

The support member may further include a lower reinforcing portion connected between a lower surface of the support portion and an inner surface of the fixing portion to prevent the support portion from sagging.

The support member may further include an upper reinforcing portion connected between an upper surface of the support portion and an inner surface of the fixing portion to separate the lower end of the outdoor heat exchanger from the fixing portion.

The fixing portion may include a fitting groove into which the flange is inserted to hold the support member.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
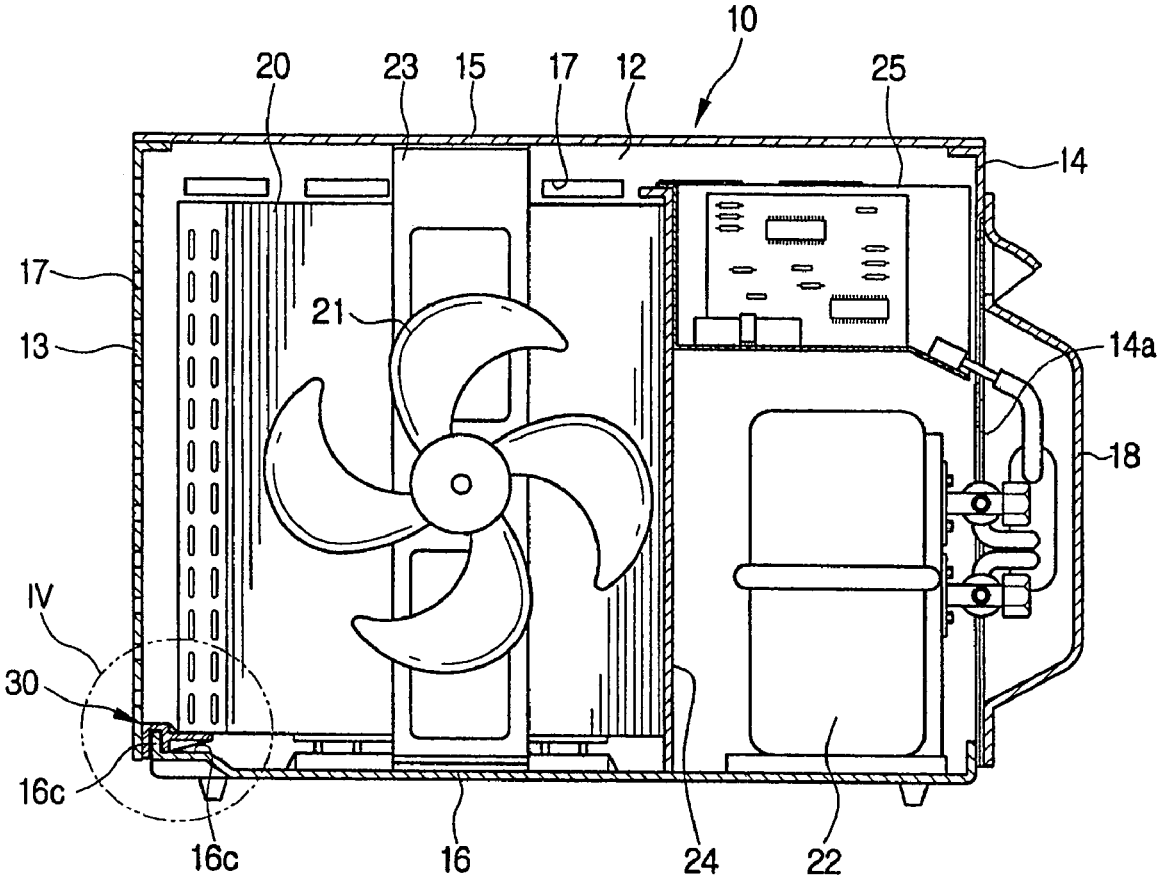
FIG. 1 is a cross-sectional view of an outdoor unit for an air conditioner, according to an embodiment of the present invention.

Reference will now be made in detail to embodiments of the present invention, examples of which are illustrated in the accompanying drawings, wherein like reference numerals refer to the like elements throughout. The description below explains the present invention by referring to the figures.

Figure 2:
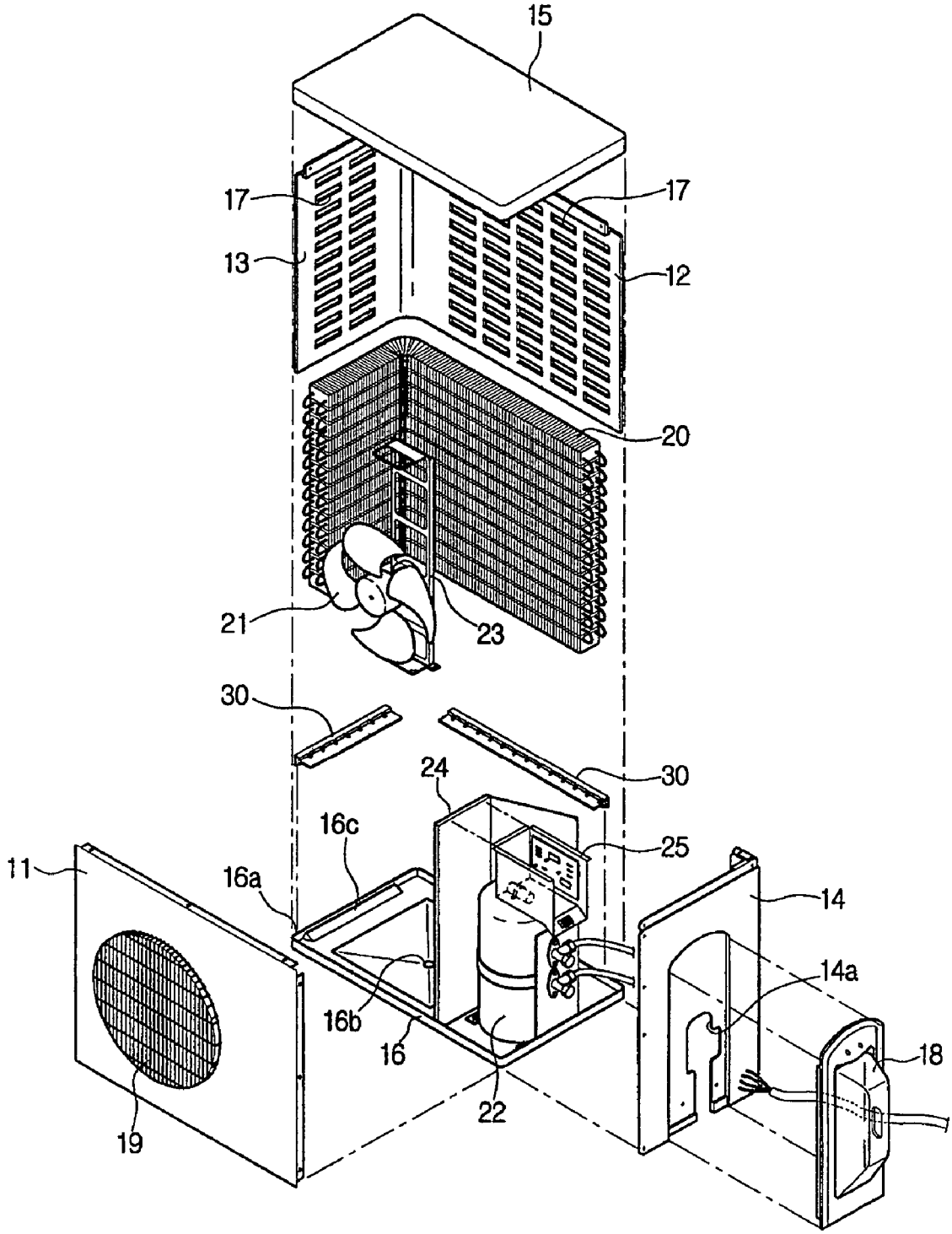
FIG. 2 is an exploded perspective view of the outdoor unit of FIG. 1.

As shown in FIGS. 1 and 2, an outdoor unit for an air conditioner according to an embodiment of the present invention includes a box-shaped cabinet 10 having a front panel 11, a rear panel 12, both side panels 13 and 14, a top panel 15, and a bottom panel 16, which are coupled to one another. The rear panel 12 and a side panel 13 of the cabinet 10 are manufactured by bending an integral plate, and include suction holes 17. The other side panel 14 includes an opening 14*a* to permit electric wires for transferring power and a refrigerant piping to pass therethrough. The opening 14*a* is covered with a cover member 18. The front panel 11 includes a discharge port 19 to allow air, which is introduced into the cabinet 10 through the suction holes 17 to be discharged to the outside.

An outdoor heat exchanger 20 may be closely installed inside the rear panel 12 and the side panel 13, which have the suction holes 17. Accordingly, outside air, which is introduced into the cabinet 10 through the suction holes 17, may be subjected to heat exchange while passing through the outdoor heat exchanger 20.

A blower fan 21 may be installed in the cabinet 10 adjacent to the front panel 11 to forcibly draw and discharge outside air, thus enabling the heat exchanger 20 to perform heat exchange. A support member 23, which is intended to support the blower fan 21, is coupled to the top panel 15 and the bottom panel 16 of the cabinet 10 at upper and lower ends thereof, respectively.

An internal space of the cabinet 10 may be comparted into a first space to accommodate the compressor 22 and a second space to accommodate the blower fan 21 by a partition plate 24. An electrical component box 25, which contains various electrical components and a circuit board, is installed in an upper portion of the first space accommodating the compressor 22. The electrical component box 25 is constructed into a parallelepiped box form to accommodate various electrical components therein.

Figure 3:
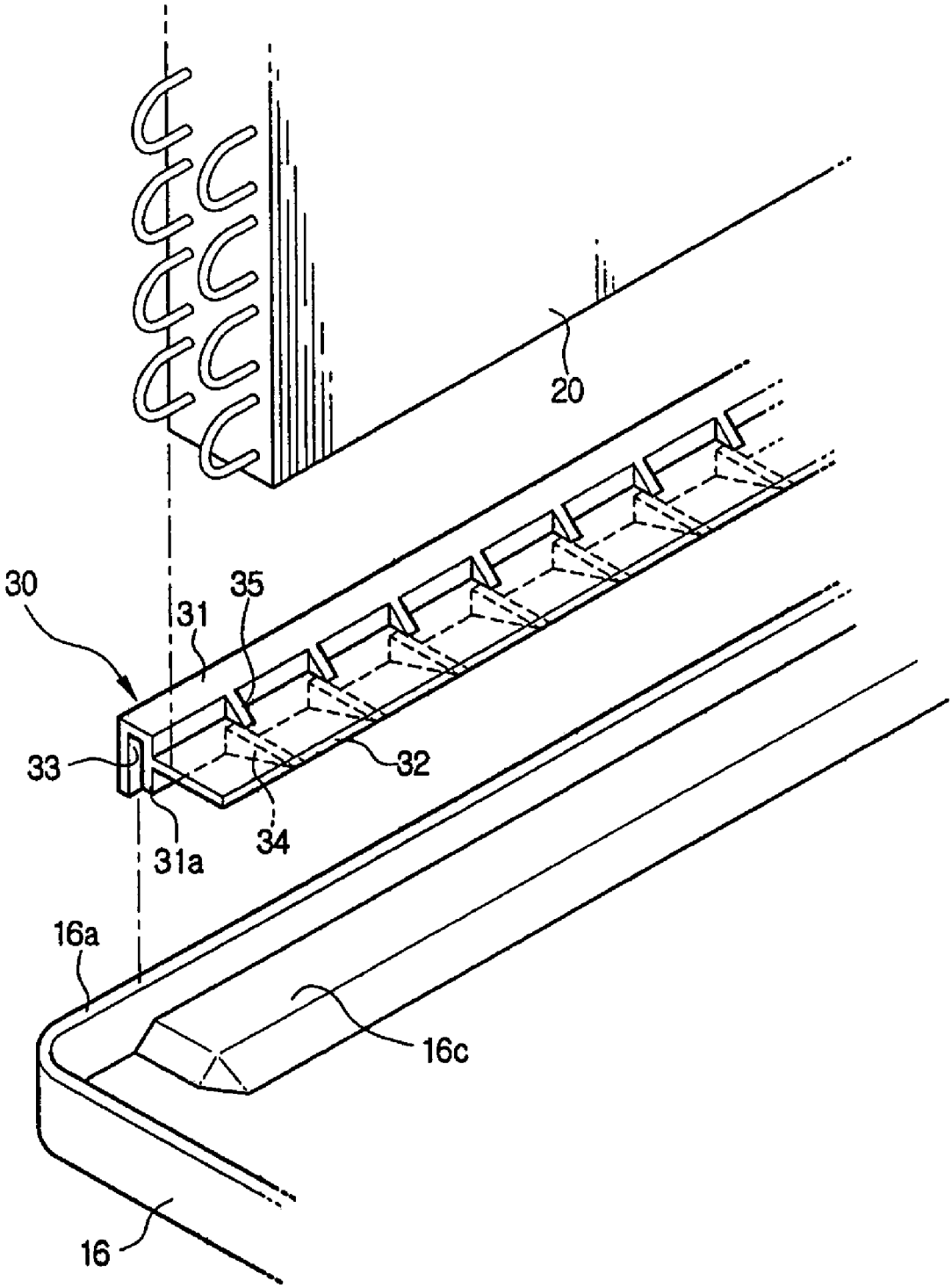
FIG. 3 is an exploded perspective view of an outdoor heat exchanger mounted on the outdoor unit of FIG. 1.
Figure 4:
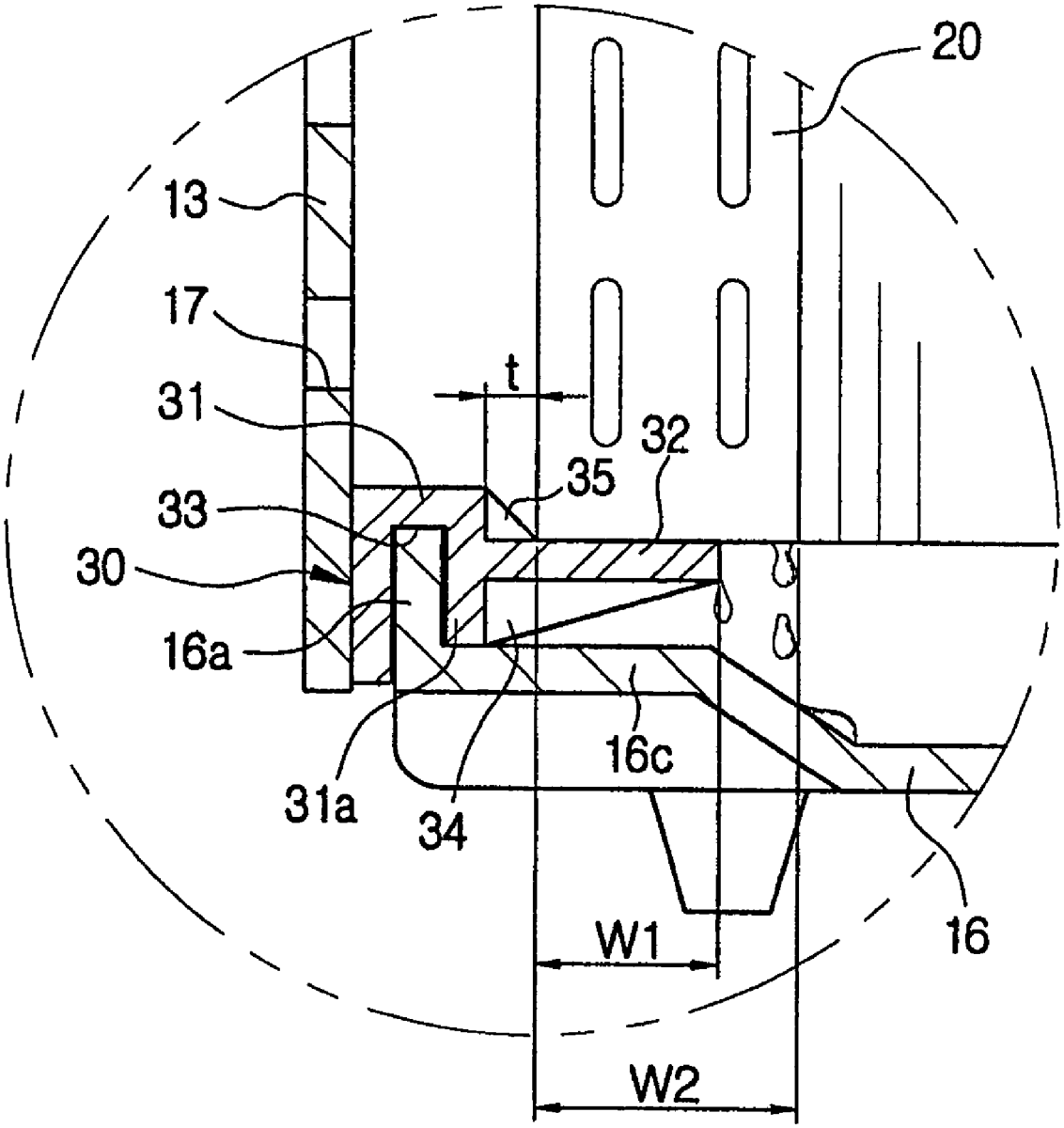
FIG. 4 is a perspective view of section IV of FIG. 1.

As shown in FIGS. 3 and 4, the bottom panel 16 of the cabinet 10 includes a flange 16*a* bent upward at four side edges thereof, so as to enable the front and rear panels 11 and 12 and both the side panels 13 and 14 to be coupled to each other and to prevent condensed water flowing from the outdoor heat exchanger 20 from flowing out of the bottom panel 16. As shown in FIG. 2, the bottom panel 16 includes a drain hole 16*b* to allow the condensed water collected on the bottom panel 16 to be discharged.

As shown in FIG. 1, the outdoor heat exchanger 20 may be supported on the bottom panel 16 of the cabinet 10 at a lower end thereof. According to an embodiment of the invention, the lower end of the outdoor heat exchanger 20 is spaced from the bottom panel 16 by the support member 30, so as to allow condensed water generated from the outdoor heat exchanger 20 to be easily discharged and to prevent freezing of the condensed water.

As shown in FIGS. 3 and 4, the bottom panel 16 includes a seat member 16*c* protruding upward from an upper surface thereof, to enable the outdoor heat exchanger 20 to be mounted thereon. The support member 30 is mounted on the seat member 16*c* and the flange 16*a*, to support the outdoor heat exchanger 20 while separating the lower end of the outdoor heat exchanger 20 from the bottom panel 16.

The support member 30 includes a fitting portion 31 extending along the flange 16*a* and fitted to the flange 16*a*, and a support portion 32 inwardly extending from an inner surface of the fitting portion 31 by a particular length to support the lower end of the outdoor heat exchanger 20. The fitting portion 31 includes a fitting groove 33 longitudinally formed on a lower surface thereof, so that the flange 16*a* is inserted into the fitting groove 33, thereby allowing the fitting portion 31 to be held by the flange 16*a*. An inner wall 31*a* of the fitting portion 31, which is formed by the fitting groove 33 and to which the support portion 32 is connected, is supported on the seat member 16*c* of the bottom panel 16.

The support member 30 includes lower reinforcing ribs 34 connected between a lower surface of the support portion 32 and an inner surface of the fitting portion 31, and upper reinforcing ribs 35 connected between an upper surface of the support portion 32 and the inner surface of the fitting portion 31, in order to prevent the support portion 32 from sagging. The upper reinforcing ribs 35 are smaller than the lower reinforcing ribs 34 such that the lower end of the outdoor heat exchanger 20 is directly supported on the upper surface of the support portion 32 while being in contact therewith.

Each of the upper reinforcing ribs 35 has an inclined upper surface, such that the outdoor heat exchanger 20 is placed on the support portion 32 with a spacing (t) between the fitting portion 31 and the outdoor heat exchanger 20. Accordingly, condensed water flowing down from the outdoor heat exchanger 20 is easily discharged, thereby preventing condensed water collected between the lower end of the outdoor heat exchanger 20 and the fitting portion 31 from freezing. As shown in FIG. 4, the support portion 32 of the support member 30 is constructed such that a width (W1) of an area of the support portion 32 in contact with the lower end of the outdoor heat exchanger 20 is smaller than a width (W2) of the outdoor heat exchanger 20. This allows condensed water flowing down on the outdoor heat exchanger 20 to drop directly onto the bottom panel 16, thereby improving discharge efficiency.

The support member 30, which supports the outdoor heat exchanger 20, may be made of heat insulating material, such as resin and rubber, by an injection molding process. Accordingly, the support member 30 prevents coldness from the outdoor heat exchanger 20 from being transmitted to the bottom panel 16, thus preventing the condensed water collected on the bottom panel 16 from freezing.

More specifically, condensed water flowing on the outdoor heat exchanger 20 falls on the bottom panel 16 via an upper surface of the support portion 32 of the support member 30. At this point, even if a certain amount of condensed water is collected on the support portion 32, coldness generated from the outdoor heat exchanger 20 is not transmitted to the support member 30 because the support portion 32 is made of a heat insulating material, thereby preventing condensed water between the lower end of the outdoor heat exchanger 20 and the support portion 32 from freezing. In addition, since the support member 30 is made of heat insulating material, coldness from the outdoor heat exchanger 20 is not transmitted to the bottom panel 16 of the cabinet 10. Accordingly, even if a certain amount of condensed water is collected on the bottom panel 16, the condensed water is not frozen.

As is apparent from the above description, an outdoor unit for an air conditioner includes an outdoor heat exchanger positioned such that a lower end of the outdoor heat exchanger is spaced from a bottom panel of a cabinet by a support member attached to edges of the bottom panel. Therefore, condensed water generated from the outdoor heat exchanger flows toward the bottom panel with ease, thereby preventing the condensed water remaining under the outdoor heat exchanger from freezing.

Furthermore, since the support member supporting the outdoor heat exchanger is made of heat insulating material, coldness from the outdoor heat exchanger is not transmitted to the bottom panel, thus preventing freezing of the condensed water.

Although a few embodiments of the present invention have been shown and described, it would be appreciated by those skilled in the art that changes may be made without departing from the principles and spirit of the invention, the scope of which is defined in the claims and their equivalents.

What is claimed is:

1. An outdoor unit for an air conditioner, comprising:

a cabinet including a front panel having a discharge port, a rear panel having suction holes, both side panels having suction holes, and a bottom panel;

an outdoor heat exchanger vertically installed in the cabinet adjacent to the suction holes;

a blower fan installed in the cabinet to blow air toward the discharge port; and a support member made of heat insulating material and disposed between the bottom panel of the cabinet and the outdoor heat exchanger, to separate a lower end of the outdoor heat exchanger from the bottom panel of the cabinet, wherein the bottom panel of the cabinet includes a flange extending upward at an edge of the bottom panel, and the support member is attached to the flange and the support member includes:

a fixing portion attached to the flange, a support portion extending from the fixing portion to support the lower end of the heat exchanger, and an upper reinforcing portion connected between an upper surface of the support portion and an inner surface of the fixing portion to separate the lower end of the outdoor heat exchanger from the fixing portion.

2. An outdoor unit for an air conditioner, comprising:

a cabinet having a bottom panel;

an outdoor heat exchanger installed in the cabinet; and a support member which supports the outdoor heat exchanger, including a support portion and a fitting portion, wherein the support member includes a plurality of lower reinforcing ribs connected between a lower surface of the support portion and an inner surface of the fitting portion, and a plurality of upper reinforcing ribs connected between an upper surface of the support portion and the inner surface of the fitting portion and prevents the support portion from sagging, and wherein the support member prevents coldness from the outdoor heat exchanger from being transmitted to the bottom panel to prevent condensed water from freezing, wherein the bottom panel of the cabinet includes a flange extending upward at an edge of the bottom panel, and the support member is attached to the flange and the support member includes:

a fixing portion attached to the flange, a support portion extending from the fixing portion to support a lower end of the heat exchanger, and an upper reinforcing portion connected between an upper surface of the support portion and an inner surface of the fixing portion to separate the lower end of the outdoor heat exchanger from the fixing portion.

3. An outdoor unit for an air conditioner, comprising:

a cabinet having a bottom panel;

an outdoor heat exchanger installed in the cabinet; and a support member which supports the outdoor heat exchanger, including a support portion and a fitting portion, wherein the support member includes a plurality of lower reinforcing ribs connected between a lower surface of the support portion and an inner surface of the fitting portion, and a plurality of upper reinforcing ribs connected between an upper surface of the support portion and the inner surface of the fitting portion and prevents the support portion from sagging, the support member prevents coldness from the outdoor heat exchanger from being transmitted to the bottom panel to prevent condensed water from freezing, and the upper reinforcing ribs are smaller than the lower reinforcing ribs such that a lower end of the outdoor heat exchanger is directly supported on the upper surface of the support portion while in contact therewith.

4. An outdoor unit for an air conditioner, comprising:

a cabinet having a bottom panel;

an outdoor heat exchanger installed in the cabinet; and a support member which supports the outdoor heat exchanger, including a support portion and a fitting portion, wherein the support member includes a plurality of lower reinforcing ribs connected between a lower surface of the support portion and an inner surface of the fitting portion, and a plurality of upper reinforcing ribs connected between an upper surface of the support portion and the inner surface of the fitting portion and prevents the support portion from sagging, the support member prevents coldness from the outdoor heat exchanger from being transmitted to the bottom panel to prevent condensed water from freezing, and each of the upper reinforcing ribs has an inclined upper surface, and the outdoor heat exchanger is placed on the support portion with a space between the fitting portion and the outdoor heat exchanger.

5. An outdoor unit for an air conditioner, comprising:

a cabinet having a bottom panel;

an outdoor heat exchanger installed in the cabinet; and a support member which supports the outdoor heat exchanger, including a support portion and a fitting portion, wherein the support member includes a plurality of lower reinforcing ribs connected between a lower surface of the support portion and an inner surface of the fitting portion, and a plurality of upper reinforcing ribs connected between an upper surface of the support portion and the inner surface of the fitting portion and prevents the support portion from sagging, the support member prevents coldness from the outdoor heat exchanger from being transmitted to the bottom panel to prevent condensed water from freezing, and a width of an area of the support portion in contact with the lower end of the outdoor heat exchanger is smaller than a width of the outdoor heat exchanger.

6. The outdoor unit for an air conditioner according to claim 2, wherein the support portion is made of a heat insulating material.

* * * * *